US010741933B2

(12) United States Patent
Yong et al.

(10) Patent No.: US 10,741,933 B2
(45) Date of Patent: Aug. 11, 2020

(54) DUAL-POLARIZATION PHASED ANTENNA ARRAYS

(71) Applicant: Apple Inc., Cupertino, CA (US)

(72) Inventors: Siwen Yong, San Francisco, CA (US); Yi Jiang, Cupertino, CA (US); Jiangfeng Wu, San Jose, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 120 days.

(21) Appl. No.: 16/032,953

(22) Filed: Jul. 11, 2018

(65) Prior Publication Data

US 2020/0021040 A1 Jan. 16, 2020

(51) Int. Cl.

| | |
|---|---|
| ***H01Q 1/24*** | (2006.01) |
| ***H01Q 21/06*** | (2006.01) |
| ***H01Q 3/26*** | (2006.01) |
| ***H01Q 3/42*** | (2006.01) |
| ***H01Q 3/38*** | (2006.01) |
| *H01Q 21/24* | (2006.01) |
| *H01Q 5/28* | (2015.01) |

(52) U.S. Cl.

CPC ..... *H01Q 21/065* (2013.01); *H01Q 3/2617* (2013.01); *H01Q 3/2635* (2013.01); *H01Q 3/38* (2013.01); *H01Q 3/42* (2013.01); *H01Q 5/28* (2015.01); *H01Q 21/245* (2013.01)

(58) Field of Classification Search

CPC ..... H01Q 21/065; H01Q 3/38; H01Q 3/2635; H01Q 3/2617; H01Q 3/42; H01Q 5/28; H01Q 21/245

See application file for complete search history.

(56) References Cited

U.S. PATENT DOCUMENTS

| | | | |
|---|---|---|---|
| 5,461,394 | A | 10/1995 | Weber |
| 7,595,759 | B2 | 9/2009 | Schlub et al. |
| 8,102,330 | B1 | 1/2012 | Albers |
| 8,971,796 | B2 | 3/2015 | Judd et al. |
| 9,118,361 | B2 | 8/2015 | Barker et al. |
| 2005/0110685 | A1 | 5/2005 | Frederik du Toit |

(Continued)

FOREIGN PATENT DOCUMENTS

| | | | |
|---|---|---|---|
| JP | 2017085289 | A | 5/2017 |
| KR | 101014347 | B1 | 2/2011 |

*Primary Examiner* — Dieu Hien T Duong

(74) *Attorney, Agent, or Firm* — Treyz Law Group, P.C.; Michael H. Lyons; Matthew R. Williams

(57) ABSTRACT

An electronic device may include a phased antenna array mounted in a conductive cavity for conveying radio-frequency signals above 10 GHz. The cavity may include sidewalls extending from a rear wall. The array may include rectangular patches each having first and second perpendicular edges. Each of the first edges in the array may be aligned with a first axis. Each of the second edges in the array may be aligned with a second axis perpendicular to the first axis. The first and second axes may be oriented at 45 degrees with respect to each of the sidewalls of the cavity. Each patch may be fed using first and second positive antenna feed terminals that cover orthogonal linear polarizations. The cavity may prevent interference while symmetrically loading the impedance of both the first and second positive antenna feed terminals in each patch.

20 Claims, 10 Drawing Sheets

(56) References Cited

U.S. PATENT DOCUMENTS

| | | | | |
|---|---|---|---|---|
| 2006/0267844 | A1 | 11/2006 | Yanagi et al. | |
| 2008/0316121 | A1 | 12/2008 | Hobson et al. | |
| 2014/0203995 | A1 | 7/2014 | Romney et al. | |
| 2014/0210486 | A1 | 7/2014 | Dijkstra | |
| 2015/0194730 | A1 | 7/2015 | Sudo et al. | |
| 2015/0333407 | A1 | 11/2015 | Yamagajo et al. | |
| 2017/0256867 | A1 | 9/2017 | Ding et al. | |
| 2018/0159203 | A1 | 6/2018 | Baks et al. | |
| 2018/0173908 | A1 | 6/2018 | Pretorius et al. | |
| 2018/0198204 | A1 | 7/2018 | Kovacic | |
| 2019/0267718 | A1* | 8/2019 | Rajagopalan ..... | H01Q 21/065 |
| 2019/0319364 | A1* | 10/2019 | Yang ..... | H01Q 1/2283 |

* cited by examiner

DUAL-POLARIZATION PHASED ANTENNA ARRAYS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums. In addition, antennas that support millimeter wave and centimeter wave communications are often particularly susceptible to electromagnetic interference from nearby electronic components.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include antennas and transceiver circuitry such as millimeter wave transceiver circuitry. The antennas may be arranged in a phased antenna array.

The phased antenna array may be mounted to a conductive rear wall of a conductive cavity in the electronic device. The conductive rear wall may have a rectangular periphery. The conductive cavity may include first, second, third, and fourth sidewalls extending from the conductive rear wall. A dielectric layer may cover the conductive cavity. The phased antenna array may transmit radio-frequency signals at a frequency between 10 GHz and 300 GHz through the dielectric layer.

The phased antenna array may include multiple patch antennas arranged in a single row or in a two-dimensional rectangular pattern. Each patch antenna may include a rectangular (e.g., square) patch element. Each patch element may have first and second perpendicular edges. The first edges of all of the patch elements in the phased antenna array may be aligned with a first axis. The second edges of all of the patch elements in the phased antenna array may be aligned with a second axis perpendicular to the first axis. The first and second axes may extend at non-parallel angles with respect to each of the first, second, third, and fourth sidewalls of the conductive cavity. For example, the first and second axes may each be oriented at 45 degrees with respect to each of the first, second, third, and fourth sidewalls of the conductive cavity.

Each patch element in the phased antenna array may be fed using first and second positive antenna feed terminals. The first positive antenna feed terminal may be coupled to the patch element along the first edge. The second positive antenna feed terminal may be coupled to the patch element along the second edge. The first and second positive antenna feed terminals may cover orthogonal linear polarizations. When arranged in this way, the center of each patch element may be located at a given distance from both the first and second sidewalls of the conductive cavity. The first and second positive antenna feed terminals of each patch element may be located at a first distance from the first sidewall and a second distance from the second sidewall.

The conductive cavity may prevent electromagnetic interference with the phased antenna array while symmetrically loading the impedance of both the first and second positive antenna feed terminals in each patch element. This may allow the phased antenna array to operate with optimal antenna efficiency using both polarizations despite being mounted within a rectangular conductive cavity.

DETAILED DESCRIPTION

Figure 1:
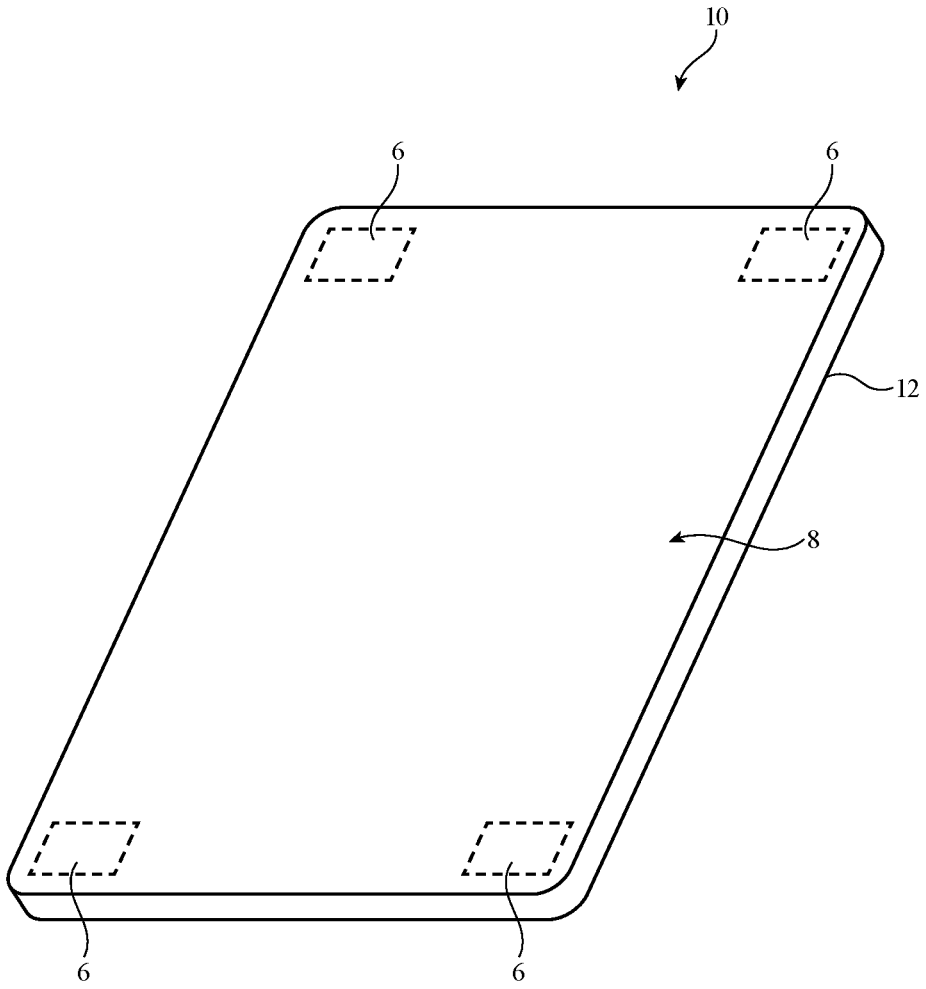
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 8. Display 8 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 8 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 8 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 8 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 8 (see, e.g., illustrative antenna locations 6 of FIG. 1). Display 8 may contain an active area with an array of pixels (e.g., a central rectangular portion). Inactive areas of display 8 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 6 of FIG. 1 and/or in corner locations on the rear of housing 12), along the peripheral edges of housing 12, on the rear of housing 12, under the display cover glass or other dielectric display cover layer that is used in covering and protecting display 8 on the front of device 10, under a dielectric window on a rear face of housing 12 or the edge of housing 12, or elsewhere in device 10.

Figure 2:
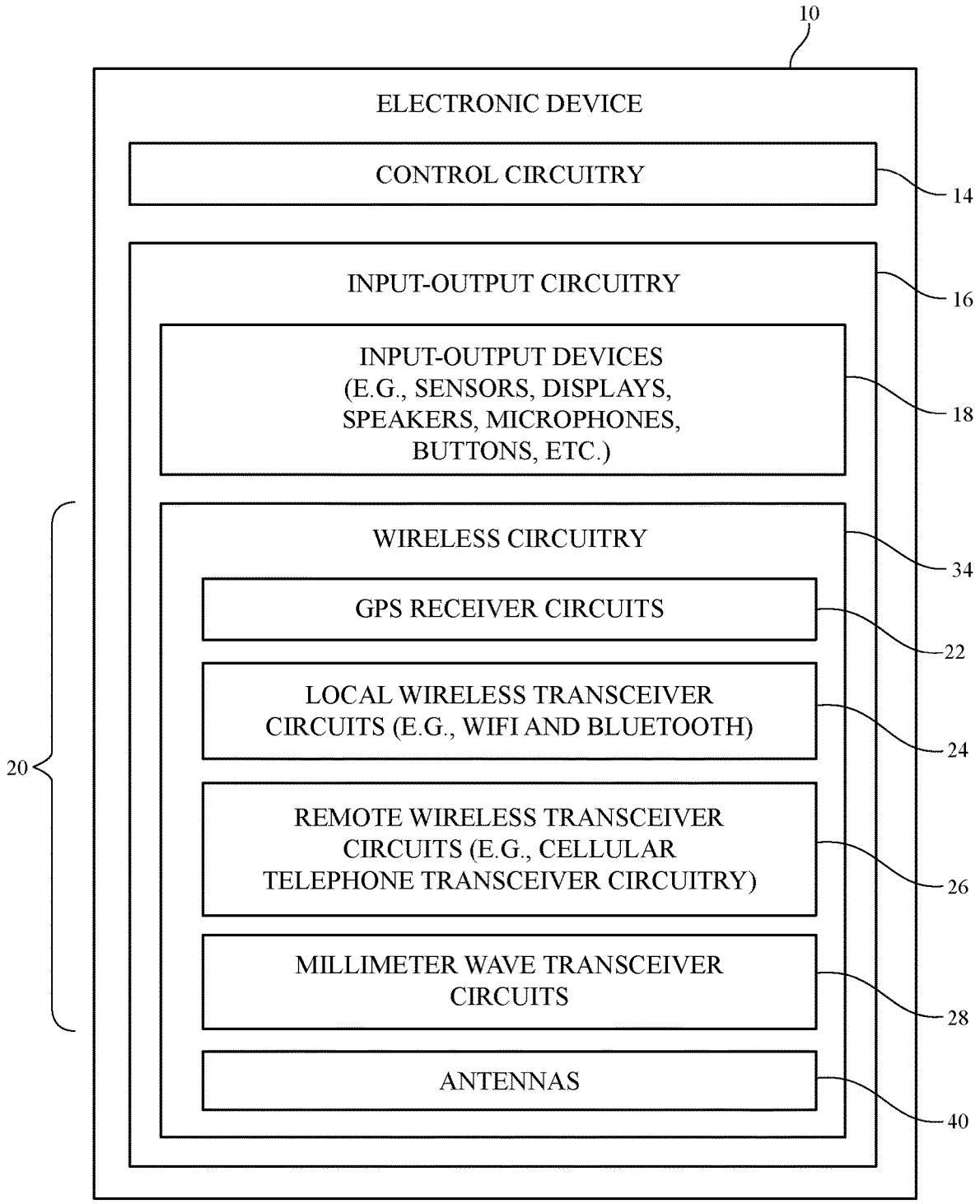
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications band from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 29.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metalized vias, microstrip transmission lines, stripline transmission lines, edge-coupled microstrip transmission lines, edge-coupled stripline transmission lines, waveguide structures, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
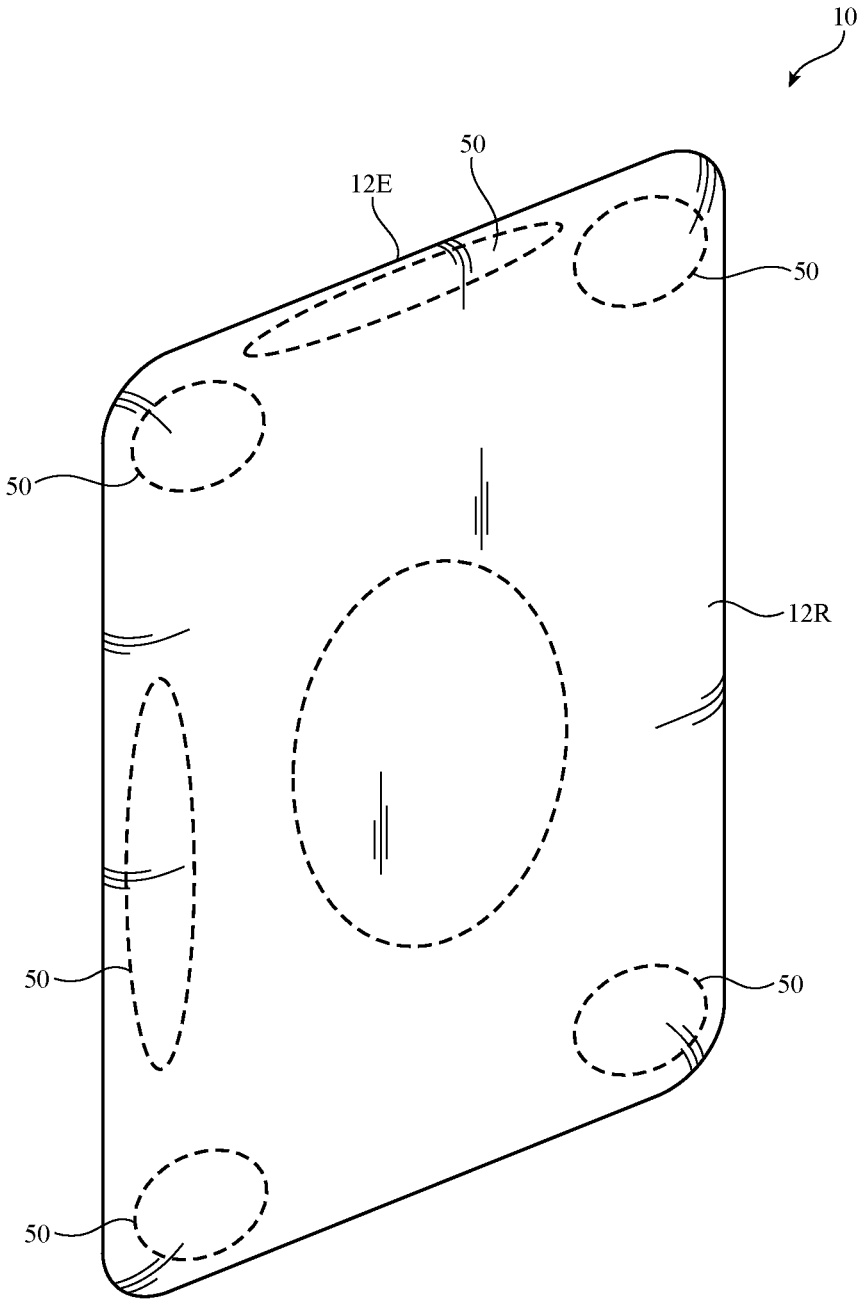
FIG. 3 is a rear perspective view of an illustrative electronic device showing exemplary locations at which antennas for communications at frequencies greater than 10 GHz may be located in accordance with an embodiment.

FIG. 3 is a rear perspective view of electronic device 10 showing illustrative locations 50 on the rear and sides of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edges formed by sidewalls 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. If desired, each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
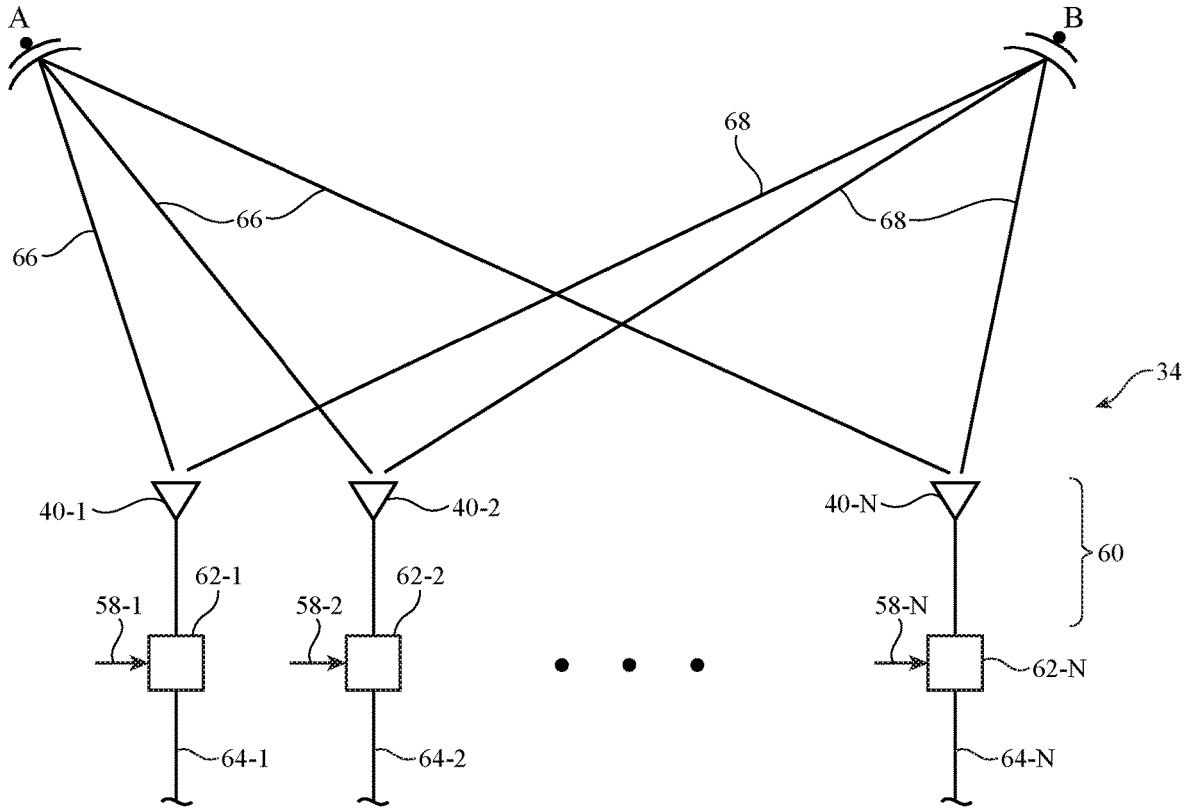
FIG. 4 is a diagram of an illustrative phased antenna array that may be adjusted using control circuitry to direct a beam of signals in accordance with an embodiment.

FIG. 4 shows how antennas 40 for handling millimeter and centimeter wave communications may be formed in a phased antenna array. As shown in FIG. 4, phased antenna array 60 (sometimes referred to herein as array 60, antenna array 60, or array 60 of antennas 40) may be coupled to signal paths such as transmission line paths 64 (e.g., one or more radio-frequency transmission lines). For example, a first antenna 40-1 in phased antenna array 60 may be coupled to a first transmission line path 64-1, a second antenna 40-2 in phased antenna array 60 may be coupled to a second transmission line path 64-2, an Nth antenna 40-N in phased antenna array 60 may be coupled to an Nth transmission line path 64-N, etc. While antennas 40 are described herein as forming a phased antenna array, the antennas 40 in phased antenna array 60 may sometimes be referred to as collectively forming a single phased array antenna.

Antennas 40 in phased antenna array 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from transceiver circuitry 28 (FIG. 2) to phased antenna array 60 for wireless transmission to external wireless equipment. During signal reception operations, transmission line paths 64 may be used to convey signals received at phased antenna array 60 from external equipment to transceiver circuitry 28 (FIG. 2).

The use of multiple antennas 40 in phased antenna array 60 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased antenna array 60).

Phase and magnitude controllers 62 may adjust the relative phases and/or magnitudes of the transmitted signals that are provided to each of the antennas in phased antenna array 60 and may adjust the relative phases and/or magnitudes of the received signals that are received by phased antenna array 60 from external equipment. Phase and magnitude controllers 62 may, if desired, include phase detection circuitry for detecting the phases of the received signals that are received by phased antenna array 60 from external equipment. The term "beam" or "signal beam" may be used herein to collectively refer to wireless signals that are transmitted and received by phased antenna array 60 in a particular direction. The term "transmit beam" may sometimes be used herein to refer to wireless radio-frequency signals that are transmitted in a particular direction whereas the term "receive beam" may sometimes be used herein to refer to wireless radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 4 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 14 of FIG. 2 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 14 may actively adjust control signals 58 in real time to steer the transmit or receive beam in different desired directions over time. Phase and magnitude controllers 62 may provide information identifying the phase of received signals to control circuitry 14 if desired.

When performing millimeter or centimeter wave communications, radio-frequency signals are conveyed over a line of sight path between phased antenna array 60 and external equipment. If the external equipment is located at location A of FIG. 4, phase and magnitude controllers 62 may be adjusted to steer the signal beam towards direction A. If the external equipment is located at location B, phase and magnitude controllers 62 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two or more degrees of freedom (e.g., in three dimensions, into and out of the page and to the left and right on the page of FIG. 4).

Figure 5:
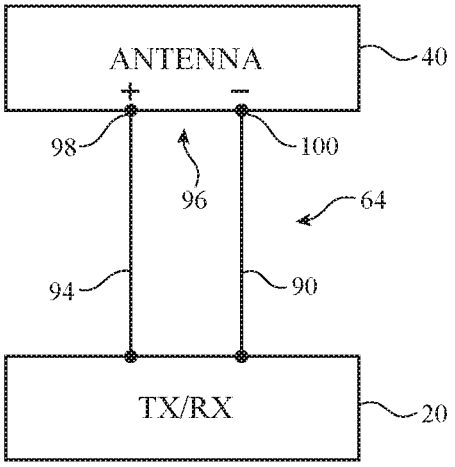
FIG. 5 is a schematic diagram of illustrative wireless communications circuitry in accordance with an embodiment.

A schematic diagram of an antenna 40 that may be formed in phased antenna array 60 (e.g., as antenna 40-1, 40-2, 40-3, and/or 40-N in phased antenna array 60 of FIG. 4) is shown in FIG. 5. As shown in FIG. 5, antenna 40 may be coupled to transceiver circuitry 20 (e.g., millimeter wave transceiver circuitry 28 of FIG. 2). Transceiver circuitry 20 may be coupled to antenna feed 96 of antenna 40 using transmission line path 64 (sometimes referred to herein as radio-frequency transmission line 64). Antenna feed 96 may include a positive antenna feed terminal such as positive antenna feed terminal 98 and may include a ground antenna feed terminal such as ground antenna feed terminal 100. Transmission line path 64 may include a positive signal conductor such as signal conductor 94 that is coupled to positive antenna feed terminal 98 and a ground conductor such as ground conductor 90 that is coupled to ground antenna feed terminal 100.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in phased antenna array 60 of FIG. 4 is shown in FIG. 6.

Figure 6:
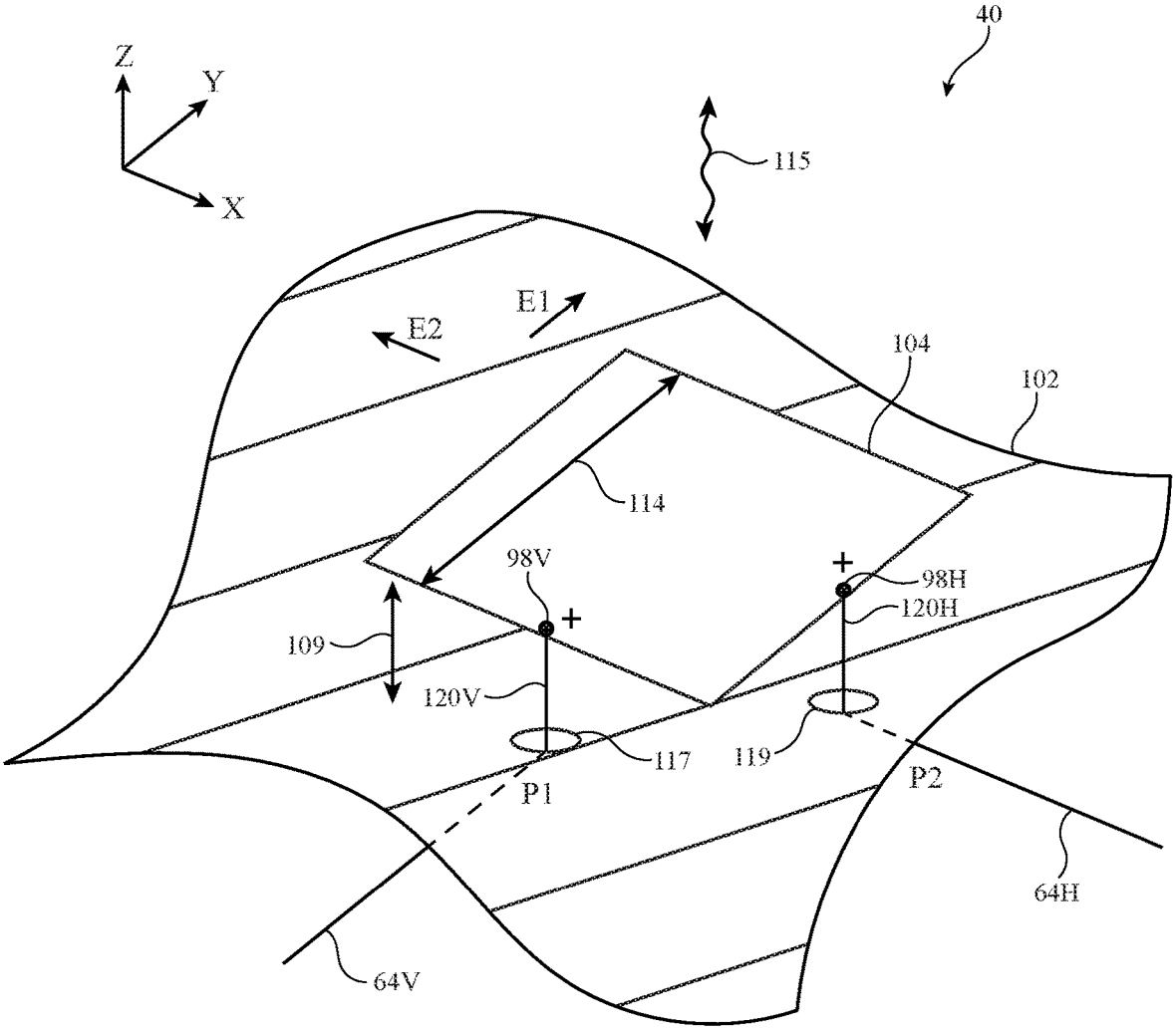
FIG. 6 is a perspective view of an illustrative patch antenna having multiple feeds for covering different polarizations in accordance with an embodiment.

As shown in FIG. 6, antenna 40 may have a patch antenna resonating element 104 that is separated from and parallel to a ground plane such as antenna ground plane 102. Patch antenna resonating element 104 may lie within a plane such as the X-Y plane of FIG. 6 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 102 may lie within a plane that is parallel to the plane of patch element 104. Patch element 104 and ground plane 102 may therefore lie in separate parallel planes that are separated by a distance 109. Patch 104 and ground plane 102 may be formed from conductive traces patterned on a dielectric substrate such as a rigid or flexible printed circuit board substrate, metal foil, stamped sheet metal, electronic device housing structures, or any other desired conductive structures.

The length of the sides of patch element 104 may be selected so that antenna 40 resonates at a desired operating frequency. For example, the sides of patch element 104 may each have a length 114 that is approximately equal to half of the wavelength of the signals conveyed by antenna 40 (e.g., the effective wavelength given the dielectric properties of the materials surrounding patch element 104). In one suitable arrangement, length 114 may be between 0.8 mm and 1.2 mm (e.g., approximately 1.1 mm) for covering a millimeter wave frequency band between 57 GHz and 70 GHz, as just one example.

The example of FIG. 6 is merely illustrative. Patch element 104 may have a square shape in which all of the sides of patch element 104 are the same length or may have a different rectangular shape. Patch element 104 may be formed in other shapes having any desired number of straight and/or curved edges. If desired, patch element 104 and ground plane 102 may have different shapes and relative orientations.

To enhance the polarizations handled by antenna 40, antenna 40 may be provided with multiple feeds. As shown in FIG. 6, antenna 40 may have a first feed at antenna port P1 that is coupled to a first transmission line path 64 such as transmission line path 64V and a second feed at antenna port P2 that is coupled to a second transmission line path 64 such as transmission line path 64H. The first antenna feed may have a first ground antenna feed terminal coupled to ground plane 102 (not shown in FIG. 6 for the sake of clarity) and a first positive antenna feed terminal 98 such as positive antenna feed terminal 98V coupled to patch element 104. The second antenna feed may have a second ground antenna feed terminal coupled to ground plane 102 (not shown in FIG. 6 for the sake of clarity) and a second positive antenna feed terminal 98 such as positive antenna feed terminal 98H coupled to patch element 104.

Holes or openings such as openings 117 and 119 may be formed in ground plane 102. Transmission line path 64V may include a vertical conductor 120V (e.g., a conductive through-via, conductive pin, metal pillar, solder bump, combinations of these, or other vertical conductive interconnect structures) that extends through hole 117 to positive antenna feed terminal 98V on patch element 104. Transmission line path 64H may include a vertical conductor 120H that extends through hole 119 to positive antenna feed terminal 98H on patch element 104. This example is merely illustrative and, if desired, other transmission line structures may be used (e.g., coaxial cable structures, stripline transmission line structures, etc.).

When using the first antenna feed associated with port P1, antenna 40 may transmit and/or receive radio-frequency signals having a first linear polarization (e.g., the electric field E1 of antenna signals 115 associated with port P1 may be oriented parallel to the Y-axis in FIG. 6). When using the antenna feed associated with port P2, antenna 40 may transmit and/or receive radio-frequency signals having a second linear polarization (e.g., the electric field E2 of antenna signals 115 associated with port P2 may be oriented parallel to the X-axis of FIG. 6 so that the linear polarizations associated with ports P1 and P2 are orthogonal to each other).

One of ports P1 and P2 may be used at a given time so that antenna 40 operates as a single-polarization antenna or both ports may be operated at the same time so that antenna 40 operates with other polarizations (e.g., as a dual-polarization antenna, a circularly-polarized antenna, an elliptically-polarized antenna, etc.). If desired, the active port may be changed over time so that antenna 40 can switch between covering vertical or horizontal polarizations at a given time. Ports P1 and P2 may be coupled to different phase and magnitude controllers 62 (FIG. 4) or may both be coupled to the same phase and magnitude controller 62. If desired, ports P1 and P2 may both be operated with the same phase and magnitude at a given time (e.g., when antenna 40 acts as a dual-polarization antenna). If desired, the phases and magnitudes of radio-frequency signals conveyed over ports P1 and P2 may be controlled separately and varied over time so that antenna 40 exhibits other polarizations (e.g., circular or elliptical polarizations).

If care is not taken, antennas 40 such as dual-polarization patch antennas of the type shown in FIG. 6 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch element 104 as shown in FIG. 6 may have insufficient bandwidth to cover the entirety of the frequency range between 57 GHz and 71 GHz. If desired, antenna 40 may include one or more parasitic antenna resonating elements that serve to broaden the bandwidth of antenna 40 (e.g., to extend the bandwidth of antenna 40 to cover an entirety of the communications band between 57 GHz and 71 GHz). The parasitic antenna resonating elements may include one or more conductive patches located above patch element 104, as an example. The length of the parasitic antenna resonating element may be greater than or less than the length of patch element 104 to add additional resonances that broaden the bandwidth of the antenna. The parasitic antenna resonating element may have a cross shape for impedance matching if desired.

Figure 7:
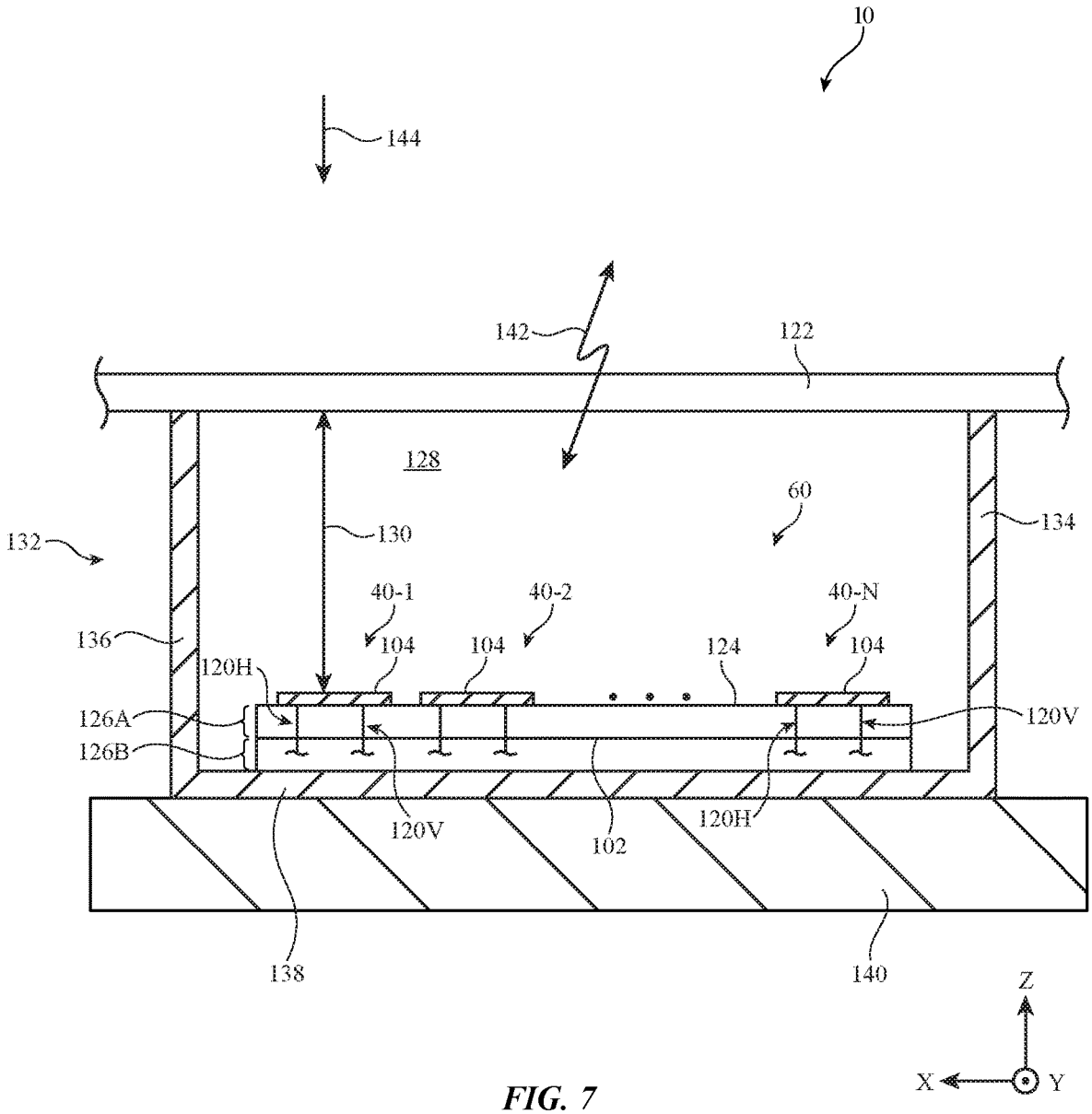
FIG. 7 is a cross-sectional side view of an illustrative electronic device having a phased antenna array mounted within a conductive shielding cavity in accordance with an embodiment.

FIG. 7 is a cross-sectional side view showing how phased antenna array 60 (FIG. 4) of antennas 40 (e.g., dual-polarization patch antennas of the type shown in FIG. 6) may be mounted within device 10. The plane of the page of FIG. 7 may, for example, lie in the X-Z plane of FIG. 6.

As shown in FIG. 7, phased antenna array 60 may be mounted within electronic device 10 behind a dielectric layer such as dielectric layer 122. Dielectric layer 122 may be a dielectric rear housing wall for device 10 (e.g., rear housing wall 12R of FIG. 3), a dielectric sidewall for device 10 (e.g., sidewall 12E of FIG. 3), a dielectric cover layer for display 8 (FIG. 1), a dielectric portion of a metal housing wall in device 10, or any other dielectric layer in device 10. If desired, dielectric layer 122 may form an exterior surface of device 10. Dielectric layer 122 may sometimes be referred to herein as dielectric cover layer 122 or dielectric cover 122. Dielectric layer 122 may be formed from an optically transparent or optically opaque material. Dielectric layer 122 may include glass, sapphire, ceramic, plastic, or any other desired material. An opaque masking layer (e.g., ink) may be coupled to an interior or exterior surface of dielectric layer 122 if desired.

Phased antenna array 60 may include any desired number of antennas 40 arranged in any desired number of rows and columns. In the example of FIG. 7, phased antenna array 60 includes a single row of N antennas 40 (e.g., phased antenna array 40 may include a first antenna 40-1, a second antenna 40-2, an Nth antenna 40-N, etc.). Antennas 40 may each be dual-polarization patch antennas of the type shown in FIG. 6, for example.

The antennas 40 in phased antenna array 60 may be formed on a dielectric substrate such as substrate 124. Substrate 124 may be, for example, a rigid or flexible printed circuit board or other dielectric substrate. Substrate 124 may include any desired dielectric materials such as epoxy, plastic, ceramic, glass, foam, or other materials. Substrate 124 may include multiple stacked dielectric layers (e.g., multiple layers of ceramic or multiple layers of printed circuit board substrate such as multiple layers of fiberglass-filled epoxy) or may include a single dielectric layer. Antennas 40 in phased antenna array 60 may be mounted at a surface of substrate 124 or may be partially or completely embedded within substrate 124 (e.g., within a single layer of substrate 124 or within multiple layers of substrate 124).

Ground plane 102 may include conductive traces embedded within substrate 124. Ground plane 102 may divide substrate 124 into transmission line layers 126B and antenna layers 126A. Transmission line layers 126B may include conductive traces used in forming transmission line paths 64 (FIGS. 4-6) for the antennas 40 in phased antenna array 60.

In the example of FIG. 7, patch elements 104 of antennas 40 are shown as being mounted to a surface of antenna layers 126A. This is merely illustrative. If desired, patch elements 104 may be embedded within antenna layers 126A. Parasitic elements overlapping patch elements 104 may be embedded within antenna layers 126A and/or formed on a surface of antenna layers 126A, if desired.

As shown in FIG. 7, each antenna 40 in phased antenna array 60 is fed using a respective pair of conductive vias 120 extending through substrate 124 (e.g., a first conductive via 120V for covering a first linear polarization and a second vertical conductive via 120H for covering a second linear polarization as shown in FIG. 6). Conductive vias 120V and 120H may be coupled to transceiver circuitry 28 (FIG. 2) and may convey radio-frequency signals between transceiver circuitry 28 and the antennas 40 in phased antenna array 60. Each antenna 40 in phased antenna array 60 may include a first positive antenna feed terminal 98V (FIG. 6) coupled to the corresponding conductive via 120V and a second positive antenna feed terminal 98H (FIG. 6) coupled to the corresponding conductive via 120H. In this way, phased antenna array 60 may cover first and second orthogonal linear polarizations and/or other polarizations such as circular or elliptical polarizations.

Each antenna 40 in phased antenna array 60 may be laterally separated (e.g., in the X-Y plane of FIG. 7) from an adjacent antenna 40 by approximately one-half of the effective wavelength of operation of phased antenna array 60 (e.g., one-half of the freespace wavelength of operation after adjusting for contributions from the dielectric materials used to form substrate 124). Antennas having different sizes for covering multiple different frequency bands may be formed within the same phased antenna array 60 if desired.

During operation, electronic components adjacent to phased antenna array 60 (e.g., display 8 of FIG. 1, antennas formed from housing 12 of FIG. 1, and/or any other electronic components in device 10) may generate electromagnetic signals. If care is not taken, these signals may electromagnetically couple into phased antenna array 60, leading to interference on the radio-frequency signals handled by phased antenna array 60.

In order to mitigate these effects, phased antenna array 60 may be mounted within a conductive shielding cavity such as conductive cavity 132. Conductive cavity 132 may sometimes be referred to herein as conductive shielding can 132, conductive shielding pocket 132, or conductive shielding bucket 132. Conductive cavity 132 may be mounted to dielectric layer 122. For example, conductive cavity 132 may be coupled to dielectric layer 122 using adhesive or may be held against dielectric layer 122 by biasing structures. In another suitable arrangement, conductive cavity 132 may be spaced apart from dielectric layer 122.

As shown in FIG. 7, conductive cavity 132 may include a conductive rear wall 138 and conductive sidewalls such as walls 136 and 134 that extend from conductive rear wall 138 towards dielectric layer 122. Conductive rear wall 138 may extend parallel to dielectric cover layer 122 or may extend at a non-parallel angle with respect to dielectric cover layer 122. Some or all of conductive rear wall 138 and/or dielectric layer 122 may be curved if desired. Conductive sidewalls 136 and 134 may extend parallel to each other or may extend at different respective angles from conductive rear wall 138. Conductive sidewalls 136 and 134 may extend perpendicular from conductive rear wall 138 and/or dielectric layer 122. If desired, one or both of conductive sidewalls 136 and 134 may extend at non-perpendicular angles from conductive rear wall 138 and/or dielectric layer 122. Conductive cavity 132 may be formed using stamped sheet metal, conductive traces on underlying substrates, conductive portions of electronic components within device 10, portions of the housing for device 10, and/or any other desired conductive structures.

Phased antenna array 60 (dielectric substrate 124) may be mounted to conductive rear wall 138 of conductive cavity 132. If desired, ground plane 102 may be shorted to conductive cavity 132 so that conductive cavity 132 serves as a part of the antenna ground for phased antenna array 60. In another suitable arrangement, ground plane 102 within dielectric substrate 124 may be omitted and conductive cavity 132 may be held at a ground potential to serve as the antenna ground for phased antenna array 60. Holes or openings may be formed in conductive cavity 132 to allow transmission line structures (e.g., transmission line paths 64 of FIGS. 4-6) to be routed between phased antenna array 60 and transceiver circuitry.

Dielectric layer 122 may be separated from phased antenna array 60 in conductive cavity 132 by a gap such as gap 128 (sometimes referred to herein as cavity 128, dielectric cavity 128, or volume 128). Cavity 128 may be filled with a dielectric material such as plastic, foam, air, etc. Cavity 128 may have a height 130 (e.g., a height defined by the vertical distance between dielectric layer 122 and patch elements 104). Height 130 may be, for example, between 1 mm and 3 mm, between 1.5 mm and 2.5 mm, approximately 2 mm, less than 1 mm, or greater than 3 mm. The dielectric properties of cavity 128 and dielectric layer 122 may be selected to impedance match phased antenna array 60 to the exterior of device 10. Dielectric layer 122 may have a uniform thickness or may have a varying thickness across its lateral area. Phased antenna array 60 may transmit and receive radio-frequency signals 142 (e.g., at millimeter and centimeter wave frequencies) through dielectric layer 122.

Conductive sidewalls including sidewalls 136 and 134 may extend around all of the lateral sides of cavity 128 (e.g., to surround the lateral periphery of phased antenna array 60 and substrate 124). In this way, conductive cavity 132 and dielectric layer 122 may completely enclose or encapsulate phased antenna array 60 within cavity 128 (e.g., the edges of cavity 128 may be defined by conductive cavity 132 and dielectric layer 122).

Conductive cavity 132 may serve to block electromagnetic signals transmitted by phased antenna array 60 from escaping cavity 128 towards the interior of device 10. Similarly, conductive cavity 132 may serve to block electromagnetic interference at phased antenna array due to the presence of other electronic components in the vicinity of phased antenna array 60. Conductive cavity 132 may also serve to block surface waves generated at the interior surface of dielectric layer 122 within cavity 128 from propagating beyond cavity 128. In this way, phased antenna array 60 may be mounted within a relatively small volume of device 10 without allowing electromagnetic interference with the operation of phased antenna array 60 at millimeter and centimeter wave frequencies. The example of FIG. 7 is merely illustrative. If desired, conductive cavity 132 may have other shapes (e.g., shapes having straight and/or curved edges or walls).

In order to dissipate heat associated with performing wireless communications at millimeter and centimeter wave frequencies (e.g., heat generated by phased antenna array 60), a heat spreader structure such as heat spreader 140 may be coupled to conductive rear wall 138 of conductive cavity 132. Heat spreader 140 may include metal or other materials having a relatively high thermal conductivity. Heat spreader 140 and may serve as a heat sink for the heat generated by phased antenna array 60 (and may therefore sometimes be referred to herein as heat sink 140) or may serve to convey or dissipate heat from cavity 128 and conductive cavity 132 to other portions of device 10 (e.g., portions of device 10 far from transceiver 28 of FIG. 2 and phased antenna array 60).

Heat spreader 140 may, for example, include fin structures to maximize the surface area of heat spreader 140 that is exposed to air (e.g., to maximize cooling rates for phased antenna array 60) or may include any other desired heat spreading structures. If desired, heat spreader 140 may be coupled to conductive rear wall 138 using adhesive, thermal paste, screws, pins, and/or any other desired interconnecting structures. Heat spreader 140 serve as part of the ground for antennas 40 if desired. The example of FIG. 7 is merely illustrative. In general, heat spreader 140 may have any desired shape or configuration, may be coupled to conductive sidewall 136, may be coupled to conductive sidewall 134, etc. Heat spreader 140 may be omitted if desired.

Figure 8:
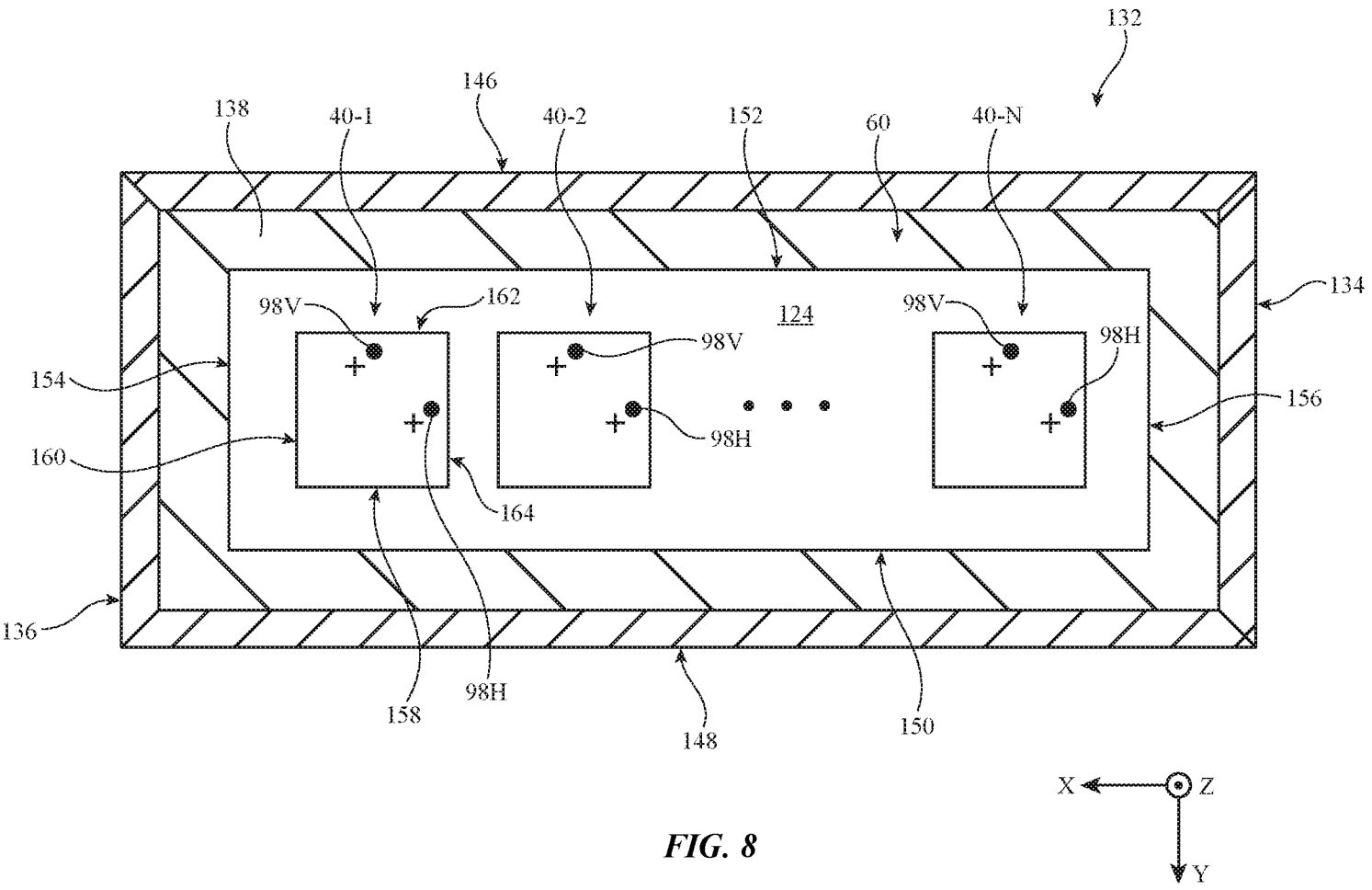
FIG. 8 is a top-down view of an illustrative phased antenna array having polarizations that are differentially loaded by a conductive shielding cavity in accordance with an embodiment.

FIG. 8 is a top-down view of phased antenna array 60 mounted within conductive cavity 132 (e.g., as taken in the direction of arrow 144 of FIG. 7). The plane of the page of FIG. 8 may, for example, lie in the X-Y plane of FIG. 7. In the example of FIG. 8, dielectric layer 122 of FIG. 7 is omitted for the sake of clarity.

As shown in FIG. 8, the N antennas 40 in phased antenna array 60 are arranged in a single 1-by-N dimensional row. This is merely illustrative. In another suitable arrangement, the N antennas 40 in phased antenna array 60 may be arranged in a J-by-K rectangular pattern, where J is the number of rows in the pattern, K is the number of columns in the pattern, and J is less than or greater than K (e.g., phased antenna array 60 may be a non-square rectangular array having fewer rows than columns or fewer columns than rows of antennas 40).

Conductive cavity 132 may include conductive sidewalls 146 and 148 extending between conductive sidewalls 136 and 134. Conductive sidewalls 146 and 148 extend vertically from conductive rear wall 138 (e.g., towards dielectric layer 122 of FIG. 7 and in the direction of the Z-axis of FIG. 8). Conductive sidewall 136 extends parallel to conductive sidewall 134 (e.g., parallel to the Y-axis of FIG. 8). Conductive sidewall 146 extends parallel to conductive sidewall 148 (e.g., parallel to the X-axis of FIG. 8). Conductive sidewalls 146 and 148 extend perpendicular to conductive sidewalls 136 and 134.

In this way, conductive cavity 132 may have a rectangular lateral shape (e.g., in the X-Y plane of FIG. 8). Conductive cavity 132 may have a length (parallel to the Y-axis of FIG. 8) and a width (parallel to the X-axis of FIG. 8) that is less than the length (e.g., because phased antenna array 60 includes more columns than rows of antennas 40). The length may sometimes be referred to herein as the lateral length and the width may sometimes be referred to herein as the lateral width of conductive cavity 132.

Substrate 124 is mounted to conductive rear wall 138 of conductive cavity 132. In the example of FIG. 8, substrate 124 has a rectangular shape with a first side 154 extending parallel to a second side 156 and with a third side 152 extending parallel to a fourth side 150. Sides 152 and 150 each extend from side 154 to side 156. When arranged in this way, side 152 of substrate 124 is located adjacent to (faces) conductive sidewall 146 of conductive cavity 132, side 156 of substrate 124 is located adjacent to conductive sidewall 134, side 150 of substrate 124 is located adjacent to conductive sidewall 148, side 154 of substrate 124 is located adjacent to conductive sidewall 136, sides 152 and 150 of substrate 124 extend parallel to conductive sidewalls 146 and 148, and sides 154 and 156 of substrate 124 extend parallel to conductive sidewalls 136 and 134. This is merely illustrative and, if desired, substrate 124 and conductive cavity 132 may have other shapes (e.g., other shapes having different numbers of straight and/or curved sides). Substrate 124 may be laterally separated from the conductive sidewalls of conductive cavity 132 (as shown in FIG. 8) or may contact the conductive sidewalls of conductive cavity 132.

As shown in the example of FIG. 8, each patch element 104 in phased antenna array 60 is oriented parallel to the sides of substrate 124 and the conductive sidewalls of conductive cavity 132. For example, each patch element 104 in phased antenna array 60 has a first edge (side) 162, a second edge (side) 164, a third edge (side) 158, and a fourth edge (side) 160. Edge 162 of each patch element 104 faces and extends parallel to side 152 of substrate 124 and conductive sidewall 146. Edge 164 of each patch element 104 faces and extends parallel to side 156 of substrate 124 and conductive sidewall 134. Edge 158 of each patch element 104 faces and extends parallel to side 150 of substrate 124 and conductive sidewall 148. Edge 160 of each patch element 104 faces and extends parallel to side 154 of substrate 124 and conductive sidewall 136.

Each patch element 104 includes a first positive antenna feed terminal 98V coupled to that patch element at edge 162 and a second positive antenna feed terminal 98H coupled to that patch element at edge 164. In this way, each patch element 104 can convey radio-frequency signals with first and second orthogonal linear polarizations (e.g., vertical and horizontal polarizations). However, when arranged in this way, the asymmetry of conductive cavity 132 due to conductive sidewall 146 being located closer to positive antenna feed terminals 98V than positive antenna feed terminals 98H may cause conductive cavity 132 to load the impedance of one polarization for phased antenna array 60 more than the other polarization (e.g., conductive cavity 132 may load the impedance of positive antenna feed terminals 98V differently than 98H). While the shape of conductive cavity 132 can be tweaked to load positive antenna feed terminals 98V with a desired impedance, doing so would generate a non-proportionate change in the impedance of positive antenna feed terminals 98H. Similarly, the shape of conductive cavity 132 can be tweaked to load positive antenna feed terminals 98H with a desired impedance, but doing so would generate a non-proportionate change in the impedance of positive antenna feed terminals 98V. This loading asymmetry across polarizations for phased antenna array 60 can limit the overall antenna efficiency for phased antenna array 60 in one of the polarizations during wireless communications.

Figure 9:
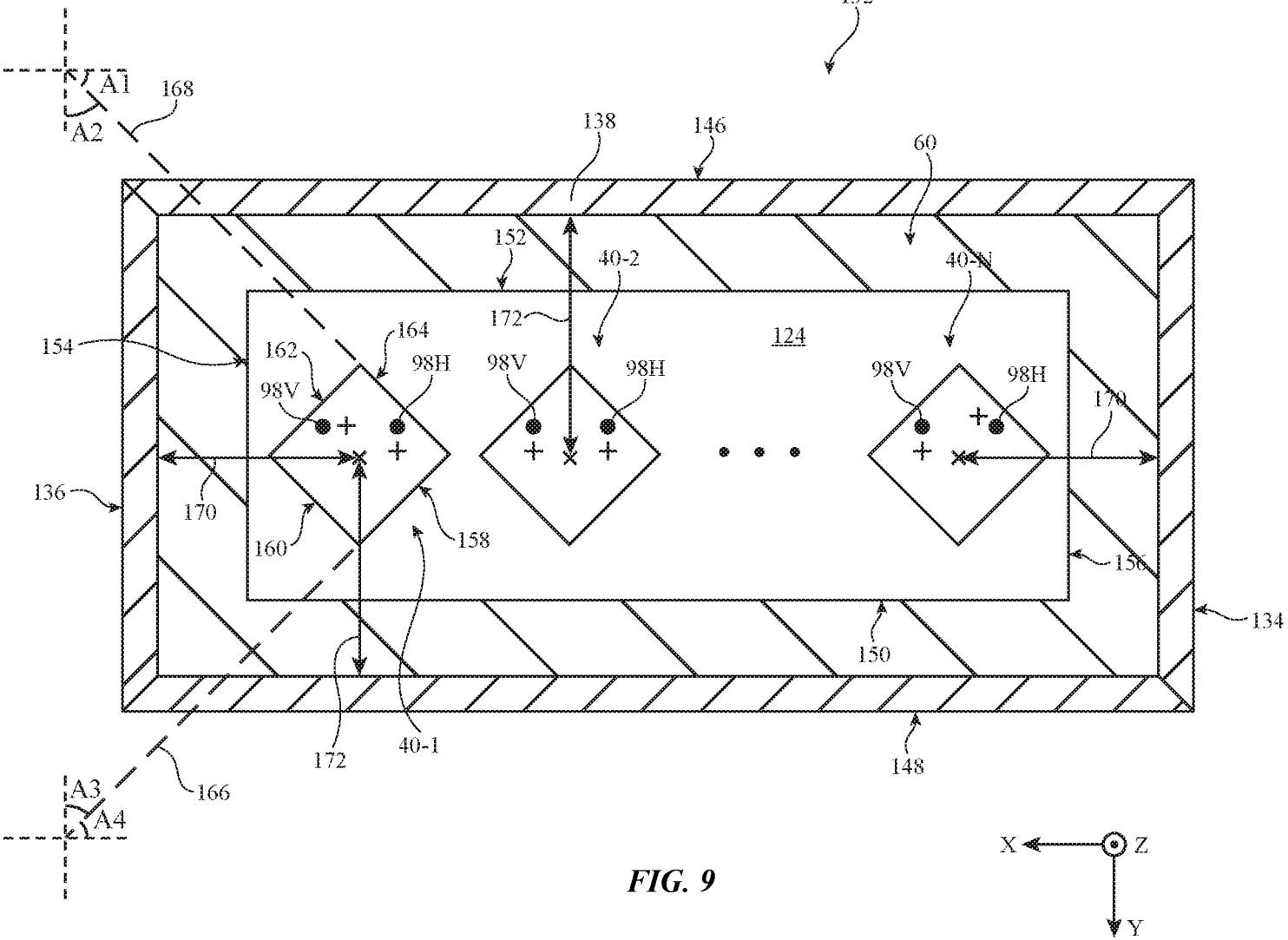
FIG. 9 is a top-down view of an illustrative phased antenna array mounted within a conductive shielding cavity and having polarizations that are equally loaded by the conductive shielding cavity in accordance with an embodiment.

In order to mitigate these effects, the antennas 40 in phased antenna array 60 may be oriented as shown in the top-down view of FIG. 9. As shown in FIG. 9, each patch element 104 in phased antenna array 60 may be rotated at an angle such that none of edges 162, 164, 160 and 158 in each patch element 104 extends parallel to conductive sidewalls 146, 134, 148, and 136 of conductive cavity 132. Similarly, none of edges 162, 164, 160, and 158 of patch elements 104 extend parallel to sides 150, 156, 152, and 154 of substrate 124.

For example, edges 160 and 164 of each patch element 104 may extend parallel to axis 168 of FIG. 9. Edges 162 and 158 of each patch element 104 may extend parallel to axis 166. Axis 168 may be oriented at angle A1 with respect to conductive sidewalls 146 and 148 and sides 152 and 150 of substrate 124. Axis 168 may be oriented at angle A2 with respect to conductive sidewalls 136 and 134 and sides 154 and 156 of substrate 124. Axis 166 may be oriented at angle A3 with respect to conductive sidewalls 136 and 134 and sides 154 and 156 of substrate 124. Axis 166 may be oriented at angle A4 with respect to conductive sidewalls 146 and 148 and sides 152 and 150 of substrate 124. Angles A1, A2, A3, and A4 are each non-zero. In one suitable arrangement, each patch element 104 is oriented at 45 degrees with respect to the sidewalls of conductive cavity 132 and the sides of substrate 124 (e.g., angles A1, A2, A3, and A4 are each equal to 45 degrees). This example is merely illustrative and, if desired, angles A1, A2, A3, and/or A4 may be any desired angles between approximately 30 degrees and 60 degrees, between 40 degrees and 50 degrees, or between 35 degrees and 55 degrees, as examples.

While patch elements 104 are rotated at non-parallel angles with respect to the conductive sidewalls of conductive cavity 132, the center of each patch element 104 may be located at the same distance 172 from both conductive sidewalls 146 and 148. Distance 172 may be approximately equal to one-half of the wavelength of operation of phased antenna array 60 (e.g., one-half of an effective wavelength compensated for dielectric loading effects from substrate 124). The center of antenna 40-1 may be located at distance 170 from conductive sidewall 136 and the center of antenna 40-N may be located at distance 170 from conductive sidewall 134. Distance 170 may, for example, be equal to distance 172 (e.g., distance 170 may be approximately one-half of the wavelength of operation of phased antenna array 60).

When oriented in this way, each positive antenna feed terminal 98V and 98H in phased antenna array 60 may be located at approximately the same distance from conductive sidewall 146. Similarly, each positive antenna feed terminal 98V and 98H in phased antenna array 60 may be located at approximately the same distance from conductive sidewall 148. This symmetry may allow conductive cavity 132 to load the impedance of one polarization for phased antenna array 60 the same as the other polarization (e.g., conductive cavity 132 may load the impedance of positive antenna feed terminals 98V the same as positive antenna feed terminals 98H). Any adjustment to conductive cavity 132 will therefore affect impedance loading across both polarizations equally. This balance in impedance loading across polarizations for phased antenna array 60 may serve to maximize the overall antenna efficiency for phased antenna array 60 for both of the polarizations.

The example of FIG. 9 is merely illustrative. If desired, phased antenna array 60 may include multiple rows of antennas 40 oriented as shown in FIG. 9 (e.g., phased antenna array 60 may include a non-square rectangular pattern of multiple rows and columns of antennas 40). Orienting the antennas as shown in FIG. 9 for each row may similarly balance impedance loading by conductive cavity 132 for the entire array, thereby maximizing antenna efficiency across both polarizations.

If desired, parasitic antenna resonating elements may be mounted over patch elements 104 in phased antenna array 60. The parasitic antenna resonating elements may be cross-shaped patches having arms that extend parallel to axes 168 and 166 (e.g., the arms may overlap positive antenna feed terminals 98V and 98H in patch elements 104). The parasitic antenna resonating elements may serve to broaden the bandwidth of antennas 40. Patch antennas 40 that are provided with parasitic antenna resonating elements in this way may sometimes be referred to as stacked patch antennas.

Figure 10:
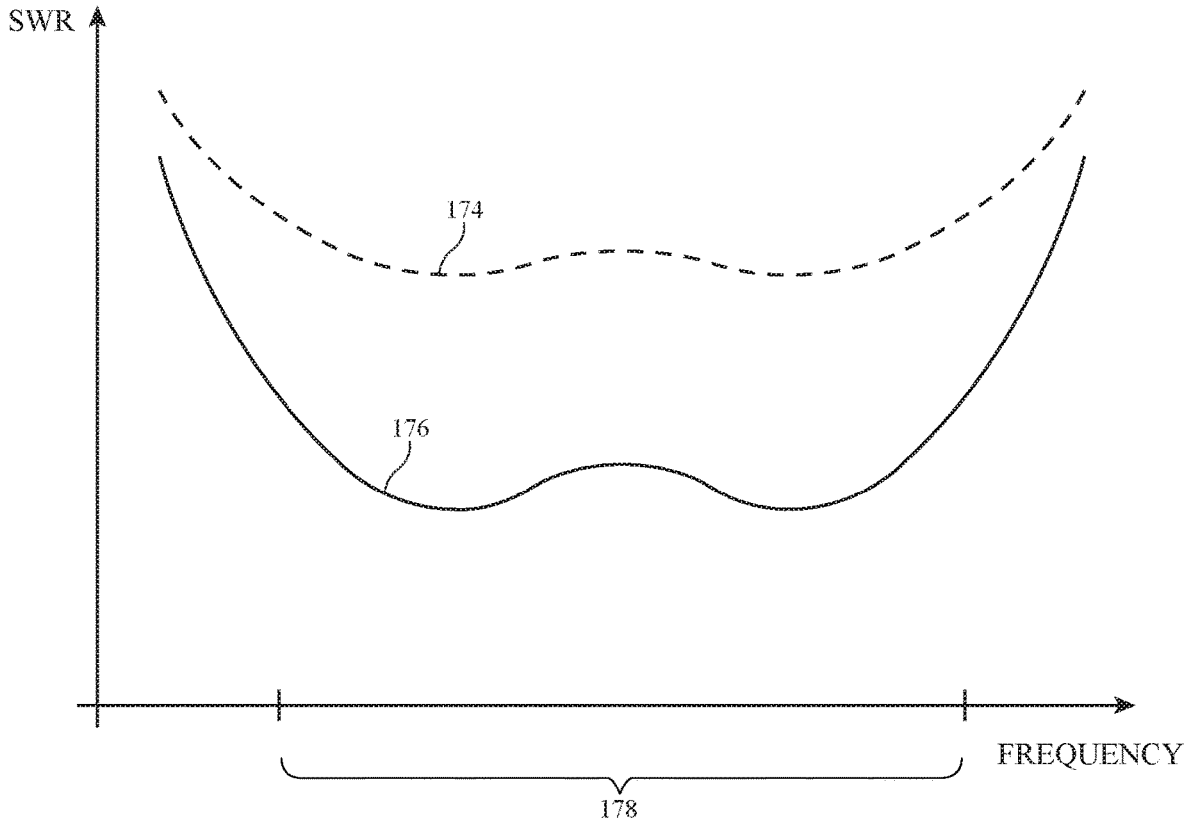
FIG. 10 is a graph of illustrative antenna performance (standing wave ratio) as a function of frequency for a phased antenna arrays of the types shown in FIGS. 8 and 9 in accordance with an embodiment.

FIG. 10 shows a plot of antenna performance (e.g., standing wave ratio) as a function of frequency for phased antenna array 60. As shown in FIG. 10, curve 174 illustrates the performance of one of the polarizations covered by a phased antenna array having patch elements 104 that are aligned with the sidewalls of conductive cavity 132 (e.g., as shown in FIG. 8). As shown by curve 174 of FIG. 10, the phased antenna array exhibits a relatively weak response across frequency band 178. Frequency band 178 may be any desired frequency band between 10 GHz and 300 GHz. Even if one of the polarizations covered by the phased antenna array exhibits a relatively strong response, asymmetric loading of the polarizations by conductive cavity 132 will limit the performance of phased antenna array 60 for the other polarization.

Curve 176 illustrates the performance of both polarizations covered by phased antenna array 60 having patch elements 104 that are rotated with respect to the sidewalls of conductive cavity 132 (e.g., as shown in FIG. 9). As shown by curve 176 of FIG. 10, phased antenna array 60 exhibits a relatively strong response across frequency band 178 (e.g., due to symmetric loading of both polarizations by conductive cavity 132).

The example of FIG. 10 is merely illustrative. Phased antenna array 60 may exhibit any desired number of wireless performance peaks at any desired number of frequencies greater than 10 GHz. In general, curves 174 and 176 may exhibit other shapes. In this way, phased antenna array 60 may operate with satisfactory antenna efficiency at millimeter and centimeter wave frequencies for two orthogonal polarizations despite being located within a rectangular conductive shielding cavity.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a conductive cavity having a conductive rear wall and conductive sidewalls extending from the conductive rear wall; and a phased antenna array mounted to the conductive rear wall within the conductive cavity and configured to transmit radio-frequency signals at a frequency between 10 GHz and 300 GHz, wherein the phased antenna array comprises a plurality of patch antenna resonating elements that are each oriented at 45 degrees with respect to the conductive sidewalls and that each comprise:

a first positive antenna feed terminal configured to transmit the radio-frequency signals with a first polarization, and a second positive antenna feed terminal configured to transmit the radio-frequency signals with a second polarization that is different than the first polarization.

2. The electronic device defined in claim 1, wherein the conductive sidewalls comprise a first conductive sidewall, a second conductive sidewall extending parallel to the first conductive sidewall, a third conductive sidewall extending perpendicular to the first conductive sidewall, and a fourth conductive sidewall extending parallel to the third conductive sidewall.

3. The electronic device defined in claim 2, wherein each patch antenna resonating element in the plurality of patch antenna resonating elements is located at a first distance from both the first and second conductive sidewalls.

4. The electronic device defined in claim 3, wherein the first distance is approximately equal to one-half of a wavelength corresponding to the frequency.

5. The electronic device defined in claim 3, wherein the first and second positive antenna feed terminals in each patch antenna resonating element of the plurality of patch antenna resonating elements is located at a second distance from the first conductive sidewall.

6. The electronic device defined in claim 1, further comprising a substrate mounted to the conductive rear wall, wherein each patch antenna resonating element in the plurality of patch antenna resonating elements is formed on the substrate.

7. The electronic device defined in claim 6, wherein the substrate has a plurality of edges and each patch antenna resonating element in the plurality of patch antenna resonating elements is oriented at 45 degrees with respect to each edge in the plurality of edges of the substrate.

8. The electronic device defined in claim 6, wherein each patch antenna resonating element in the plurality of patch antenna resonating elements comprises a square conductive trace on the substrate.

9. The electronic device defined in claim 8, wherein each square conductive trace in the plurality of patch antenna resonating elements has first and second sides, the first positive antenna feed terminal in each patch antenna resonating element is located at the first side, and the second positive antenna feed terminal in each patch antenna resonating element is located at the second side.

10. The electronic device defined in claim 1, further comprising:

a dielectric layer, wherein the conductive sidewalls are mounted to the dielectric layer and the phased antenna array is configured to transmit the radio-frequency signals through the dielectric layer.

11. Apparatus comprising:

a conductive cavity having a rectangular rear wall and first, second, third, and fourth walls extending from a periphery of the rectangular rear wall;

a phased antenna array mounted to the rectangular rear wall and configured to transmit radio-frequency signals at a frequency greater than 10 GHz, wherein the phased antenna array comprises:

a first rectangular patch having first and second perpendicular edges, a second rectangular patch having a third and fourth perpendicular edges, wherein the third edge extends along an axis parallel to the first edge and the fourth edge extends along an axis parallel to the second edge, a first positive antenna feed terminal coupled to the first rectangular patch at the first edge, a second positive antenna feed terminal coupled to the first rectangular patch at the second edge, a third positive antenna feed terminal coupled to the second rectangular patch at the third edge, and a fourth positive antenna feed terminal coupled to the second rectangular patch at the fourth edge, wherein the first, second, third, and fourth edges each extend non-parallel with respect to the first, second, third, and fourth walls of the conductive cavity.

12. The apparatus defined in claim 11, wherein the first and second rectangular patches are both located at a first distance from the first wall of the conductive cavity.

13. The apparatus defined in claim 12, wherein the first and second rectangular patches are both located at the first distance from the second wall of the conductive cavity.

14. The apparatus defined in claim 13, wherein the first, second, third, and fourth positive antenna feed terminals are each located at a second distance from the first wall of the conductive cavity.

15. The apparatus defined in claim 14, wherein the first, second, third, and fourth positive antenna feed terminals are each located at a third distance from the second wall of the conductive cavity, the third distance being greater than the second distance.

16. The apparatus defined in claim 12, wherein the first and third edges each extend at a first angle between 30 degrees and 60 degrees with respect to the first and second walls, the first and third edges each extend at a second angle between 30 degrees and 60 degrees with respect to the third and fourth walls, the second and fourth edges each extend at a third angle between 30 degrees and 60 degrees with respect to the first and second walls, and the second and fourth edges each extend at a fourth angle between 30 degrees and 60 degrees with respect to the third and fourth walls.

17. The apparatus defined in claim 16, wherein the first, second, third, and fourth angles are each equal to 45 degrees.

18. An electronic device comprising:

a touch-sensitive display;

a dielectric layer;

a conductive cavity having first and second perpendicular conductive walls extending from edges of a rear conductive wall;

a phased antenna array mounted to the rear conductive wall within the conductive cavity and configured to transmit radio-frequency signals at a frequency greater than 10 GHz through the dielectric layer, wherein the phased antenna array comprises a row of antennas, each antenna in the row of antennas comprising:

a rectangular antenna resonating element having first and second perpendicular sides, a first positive antenna feed terminal coupled to the rectangular antenna resonating element along the first side, and a second positive antenna feed terminal coupled to the rectangular antenna resonating element along the second side, wherein the first and second sides each extend at 45 degrees with respect to both the first and second conductive walls.

19. The electronic device defined in claim 18, wherein the conductive cavity comprises a third conductive wall extending parallel to the first conductive wall, and the first and second positive antenna feed terminals from each antenna in the row of antennas are both located at a first distance from the first conductive wall and at a second distance that is greater than the first distance from the third conductive wall.

20. The electronic device defined in claim 19, wherein the dielectric layer comprises a dielectric cover layer for the touch-sensitive display.

* * * * *